US011833443B2

(12) United States Patent
Yamaai et al.

(10) Patent No.: US 11,833,443 B2
(45) Date of Patent: Dec. 5, 2023

(54) CONNECTION UNIT

(71) Applicant: ZEON CORPORATION, Tokyo (JP)

(72) Inventors: Midori Yamaai, Tokyo (JP); Naomi Shiga, Tokyo (JP); Masayoshi Yoshida, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 18/046,217

(22) Filed: Oct. 13, 2022

(65) Prior Publication Data

US 2023/0053520 A1 Feb. 23, 2023

Related U.S. Application Data

(63) Continuation of application No. 17/056,419, filed as application No. PCT/JP2019/019086 on May 14, 2019, now abandoned.

(30) Foreign Application Priority Data

May 31, 2018 (JP) ..... 2018-105174

(51) Int. Cl.
*A63H 33/04* (2006.01)
*A63H 29/22* (2006.01)

(52) U.S. Cl.
CPC ..... *A63H 33/042* (2013.01); *A63H 29/22* (2013.01); *A63H 33/046* (2013.01)

(58) Field of Classification Search
CPC ... A63H 33/046; H01R 13/6205; H01R 11/30
(Continued)

(56) References Cited

U.S. PATENT DOCUMENTS 3,144,527 A * 8/1964 Tolegian ..... H01J 5/54 200/51.09
3,530,614 A 9/1970 Strongin
(Continued)

FOREIGN PATENT DOCUMENTS

JP H11128547 A 5/1999
JP 2015526208 A 9/2015
(Continued)

OTHER PUBLICATIONS

Dec. 1, 2020, International Preliminary Report on Patentability issued in the International Patent Application No. PCT/JP2019/019086.
(Continued)

*Primary Examiner* — Eugene L Kim
*Assistant Examiner* — Matthew B Stanczak
(74) *Attorney, Agent, or Firm* — KENJA IP LAW PC

(57) ABSTRACT

A connection unit includes: a body having peripheral edges; magnets, at least one of which being disposed on each side of the peripheral edges of the body; and electrode terminals, at least three of which being disposed on the each side of the peripheral edges of the body. An outer surface of the body has a curved surface. The electrode terminals are disposed along the curved surface or the surface having the polygonal cross section of the outer surface. The electrode terminals disposed on the peripheral edges of the body have either: one positive electrode terminal and two negative electrode terminals, or one negative electrode terminal and two positive electrode terminals.

9 Claims, 11 Drawing Sheets

(58) Field of Classification Search
USPC ..... 439/305, 38
See application file for complete search history.

(56) References Cited

U.S. PATENT DOCUMENTS 4,199,894 A * 4/1980 Fischer ..... A63H 33/042 136/251
5,921,783 A 7/1999 Fritsch et al.
5,941,714 A * 8/1999 Gorbet ..... H01R 12/721 439/38
6,062,937 A 5/2000 Kikuchi
7,255,624 B2 8/2007 Daftari
7,322,873 B2 1/2008 Rosen et al.
7,846,002 B1 12/2010 Mikesell et al.
7,887,056 B2 2/2011 Tenorio
8,458,863 B2 * 6/2013 Hunts ..... H01F 7/0242 446/92
8,491,312 B2 * 7/2013 Rudisill ..... H01R 11/30 439/39
8,529,274 B2 * 9/2013 Li ..... H01R 13/6205 439/38
8,873,239 B2 10/2014 Mcrae et al.
9,022,829 B2 * 5/2015 Rosen ..... A63H 33/046 446/131
9,312,633 B1 4/2016 Szeto et al.
9,400,569 B2 7/2016 Li
9,472,112 B2 10/2016 Schweikardt et al.
9,597,607 B2 3/2017 Bdeir
9,627,803 B2 4/2017 Szeto et al.
9,636,600 B2 * 5/2017 Rudisill ..... A63H 33/046
9,643,100 B2 * 5/2017 Fein ..... A63H 33/046
9,653,844 B1 * 5/2017 Szeto ..... H01R 13/6205
9,755,357 B1 9/2017 Kim et al.
9,774,136 B2 * 9/2017 Szeto ..... H01R 35/04
9,907,195 B2 2/2018 Montazeri
10,027,057 B2 * 7/2018 Szeto ..... H01R 13/6205
10,036,186 B2 * 7/2018 Kim ..... E05D 1/06
10,080,977 B2 * 9/2018 Rosen ..... A63H 33/08
10,155,153 B2 12/2018 Binder
10,245,523 B2 * 4/2019 Lin ..... A63H 33/26
10,531,542 B2 1/2020 Rodinger et al.
10,670,260 B1 6/2020 Wells
10,819,065 B2 * 10/2020 Xiong ..... H01R 13/6205
10,857,475 B2 12/2020 Moskowitz
10,860,274 B2 12/2020 Son et al.
10,886,051 B2 1/2021 Osipov
10,918,963 B2 * 2/2021 Ornstein ..... A63H 33/06
11,144,096 B2 * 10/2021 Cho ..... G06F 1/1626
11,642,604 B1 * 5/2023 Xie ..... A63H 33/046 446/92
2006/0134978 A1 * 6/2006 Rosen ..... H01R 13/514 439/581
2007/0287302 A1 * 12/2007 Lindberg ..... H01R 13/6205 439/38
2010/0197148 A1 * 8/2010 Rudisill ..... H01R 13/6205 439/40
2011/0097996 A1 4/2011 Kalanithi et al.
2011/0143629 A1 * 6/2011 Seymour ..... A63H 33/042 446/91
2012/0208378 A1 8/2012 Rudisill et al.
2012/0295451 A1 11/2012 Hyun-Jun et al.
2013/0109267 A1 5/2013 Schweikardt et al.
2013/0273752 A1 * 10/2013 Rudisill ..... H01R 13/6205 439/39
2014/0065846 A1 * 3/2014 Poh ..... H01R 13/6205 439/39
2014/0302741 A1 10/2014 Whittaker
2015/0079872 A1 3/2015 Howard
2016/0074766 A1 * 3/2016 Choi ..... A63H 33/046 446/92
2016/0129361 A1 5/2016 Howard
2016/0204545 A1 7/2016 Szeto et al.
2016/0268729 A1 9/2016 Szeto
2017/0085213 A1 3/2017 Petrin et al.
2017/0149171 A1 5/2017 Szeto
2017/0252664 A1 * 9/2017 Cletheroe ..... A63H 33/046
2017/0257146 A1 9/2017 Szeto
2017/0291116 A1 10/2017 Macdonald et al.
2017/0310042 A1 * 10/2017 Michelmann ..... H04M 1/0216
2019/0054388 A1 * 2/2019 Cranias ..... A63H 33/26
2019/0173301 A1 * 6/2019 Narayanasamy ..... H02J 7/0045
2020/0161803 A1 * 5/2020 Xiong ..... A63H 33/042
2020/0376402 A1 * 12/2020 Wellejus ..... A63H 33/042
2021/0213369 A1 * 7/2021 Yamaai ..... A63H 33/046
2021/0220723 A1 * 7/2021 Costello ..... A63F 3/00
2022/0297021 A1 * 9/2022 Liu ..... A63H 33/22

FOREIGN PATENT DOCUMENTS

JP 2017018322 A 1/2017
WO 2014032043 A1 2/2014

OTHER PUBLICATIONS

Feb. 9, 2022, the Extended European Search Report issued by the European Patent Office in the corresponding European Patent Application No. 19810983.7.

* cited by examiner

CONNECTION UNIT

CROSS-REFERENCE TO RELATED APPLICATIONS

The present application is a continuation application of U.S. patent application Ser. No. 17/056,419 filed Nov. 18, 2020, which is a National Stage Application of PCT/JP2019/019086 filed May 14, 2019, which claims priority of Japanese Patent Application No. 2018-105174 filed May 31, 2018. The disclosures of the prior applications are hereby incorporated by reference herein in their entirety.

TECHNICAL FIELD

The present disclosure relates to a connection unit.

BACKGROUND

Toys are known in which flat plate connection units are magnetically connected so as to be three-dimensionally combined into a variety of shapes.

For example, PTL 1 discloses an intelligent toy having a plurality of plate members (connection units) with magnets provided on its peripheral edge so that they are magnetically connected into a three-dimensional assembly.

CITATION LIST

Patent Literature

PTL 1: JP2017-018322A

SUMMARY

Technical Problem

If connection units which can be magnetically connected into an assembly can also be electrically connectable to each other, it is possible to provide them with various electrical mechanisms. This makes it possible to provide a toy that is more enjoyable than those whose connection units are simply magnetically connectable into an assembly.

It is therefore an object of present disclosure to solve the above-mentioned problem and to provide a connection unit which is magnetically and electrically connectable.

Solution to Problem

The present disclosure aims to advantageously solve the problem set forth above, and a connection unit disclosed herein comprises: a body having a substantially flat plate shape; a magnet disposed on at least one side of a peripheral edge of the body; and at least three electrode terminals disposed on the one side of the body, the one side having the magnet disposed thereon, wherein an outer surface of the one side of the body has a curved surface which curves in a thickness direction or a surface having a polygonal cross section, the electrode terminals are disposed along the curved surface or the surface having the polygonal cross section of the outer surface, the at least three electrode terminals comprise one or more positive electrode terminals and one or more negative electrode terminals, and the one or more positive electrode terminals and the one or more negative electrode terminals are disposed on the one side so as to be line-symmetrical about a perpendicular line perpendicular to the one side of the body and crossing the center of the one side of the body. With such a configuration, the connection unit of the present disclosure can be magnetically connected to another connection unit by a magnet disposed at one side of the peripheral edge of the body. At this time, the connection unit can be electrically connected to the other connection unit by electrode terminals disposed at the one side. The connection unit of the present disclosure can therefore be magnetically and electrically connectable to another connection unit. Further, because the electrode terminals are disposed along a curved surface or a surface having a polygonal cross section of the outer surface of the body, it is possible to allow the connection angle θ to have a high degree of freedom when connecting the connection unit of the present disclosure to another connection unit. Also, because the positive electrode terminal(s) and negative electrode terminal(s) are disposed so as to be line-symmetrical about a perpendicular line perpendicular to the one side of the body and crossing the center of the one side of the body, the connection unit of the present disclosure is connectable to another connection unit even if it is turned upside down.

It is preferred that the connection unit of the present disclosure further comprises a circuit element disposed inside the body and the circuit element is electrically connected to the electrode terminals. With such a configuration, the power generated by the circuit element can be output from the electrode terminals, or the power that is input from the electrode terminals can be consumed by the circuit element.

It is preferred that the connection unit of the present disclosure further comprises a wiring board disposed in the inside of the body and the circuit element is electrically connected to the electrode terminals via a wiring of the wiring board. With such a configuration, it is possible to easily establish a connection between the circuit element and the electrode terminals in a space-saving manner.

In the connection unit of the present disclosure, it is preferred that the circuit element comprises an energy harvesting element capable of outputting power, generated by energy harvesting, from the electrode terminals. With such a configuration, the power generated by energy harvesting can be output from the electrode terminals.

In the connection unit of the present disclosure, it is preferred that the circuit element comprises a load element capable of consuming power that is input from the electrode terminals. With such a configuration, the power that is input from the electrode terminals can be consumed by the load element.

In the connection unit of the present disclosure, it is preferred that the load element is a light-emitting element. With such a configuration, the connection unit can be used as a lighting device configured to emit light by means of the power that is input from the electrode terminals.

It is preferred that the connection unit of the present disclosure further comprises at the peripheral edge of the body a load element that is electrically connected to the electrode terminals. With such a configuration, the load element can be easily mounted on the connection unit.

In the connection unit of the present disclosure, it is preferred that the body has a substantially polygonal shape in plan view.

In the connection unit of the present disclosure, it is preferred that the body has a frame shape having an opening.

Advantageous Effect

According to the present disclosure, it is possible to provide a connection unit which is magnetically and electrically connectable.

DETAILED DESCRIPTION

Figure 1:
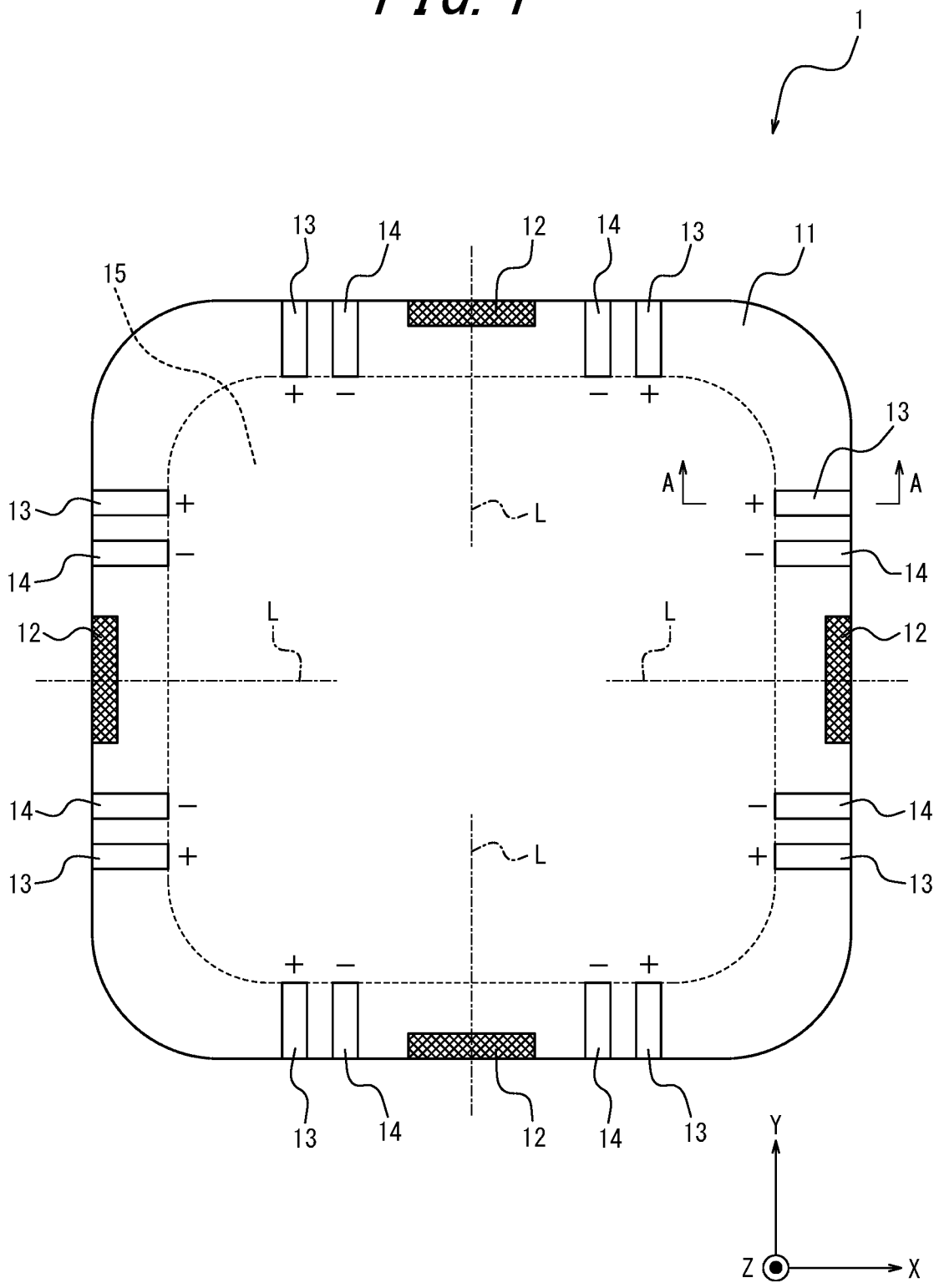
FIG. 1 illustrates a schematic configuration of a connection unit according to an embodiment of present disclosure.

Hereinafter, embodiments of the present disclosure will be described with reference to the accompanying drawings. Components common among the drawings are given the same reference numerals.

FIG. 1 illustrates a schematic configuration of a connection unit 1 according to an embodiment of the present disclosure. The connection unit 1 is magnetically connectable to other connection unit(s) 1. A user can form an assembly of various three-dimensional shapes by magnetically connecting a plurality of connection units 1 into an assembly.

The connection unit 1, as illustrated in FIG. 1, comprises a body 11, a magnet 12, a positive electrode terminal 13, a negative electrode terminal 14, and a circuit element 15. The positive electrode terminal 13 and the negative electrode terminal 14 are also collectively referred to as "electrode terminals."

The body 11 has a substantially flat plate shape. The term "substantially flat plate shape" as used herein means both a flat plate shape and a frame shape having an opening in the inside. FIG. 1 illustrates an embodiment wherein the body 11 has a flat plate shape having no opening.

The body 11 has a substantially polygonal shape in plan view. The term "substantially polygonal shape" as used herein means both a general polygonal shape and a polygonal shape whose corners are curved. FIG. 1 illustrates an example of an embodiment wherein the body 11 has a quadrangular shape with curved corners in plan view. The term "plan view" refers to a view seen in the Z-axis direction in FIG. 1.

The body 11 may be made of resin or other materials.

Figure 2A:
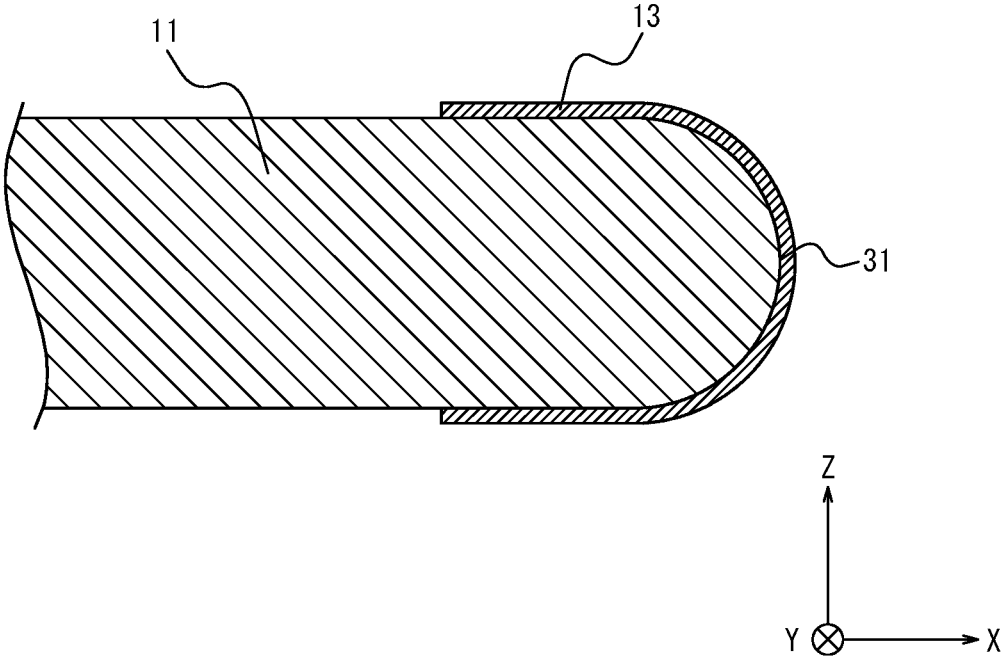
FIG. 2A illustrates an example of a schematic configuration of a cross section of the connection unit illustrated in FIG. 1 taken along line A-A.

FIG. 2A illustrates an example of a schematic configuration of a cross section taken along line A-A in FIG. 1. As illustrated in FIG. 2A, an outer surface 31 of the body 11 has a curved surface that is curved in the thickness direction. The phrase "curved in the thickness direction" as used herein means that the vicinity of the center of the outer surface 31 of the body 11 protrudes in the positive direction of the X-axis.

The magnet 12 is disposed at the peripheral edge of the body 11 as illustrated in FIG. 1. In the example illustrated in FIG. 1, the magnet 12 is disposed on each of the four sides of the peripheral edge of the body 11. However, the arrangement of the magnet 12 is not limited to this particular example; it is only necessary that the magnet 12 is disposed on least one side of the peripheral edge of the body 11.

Figure 3:
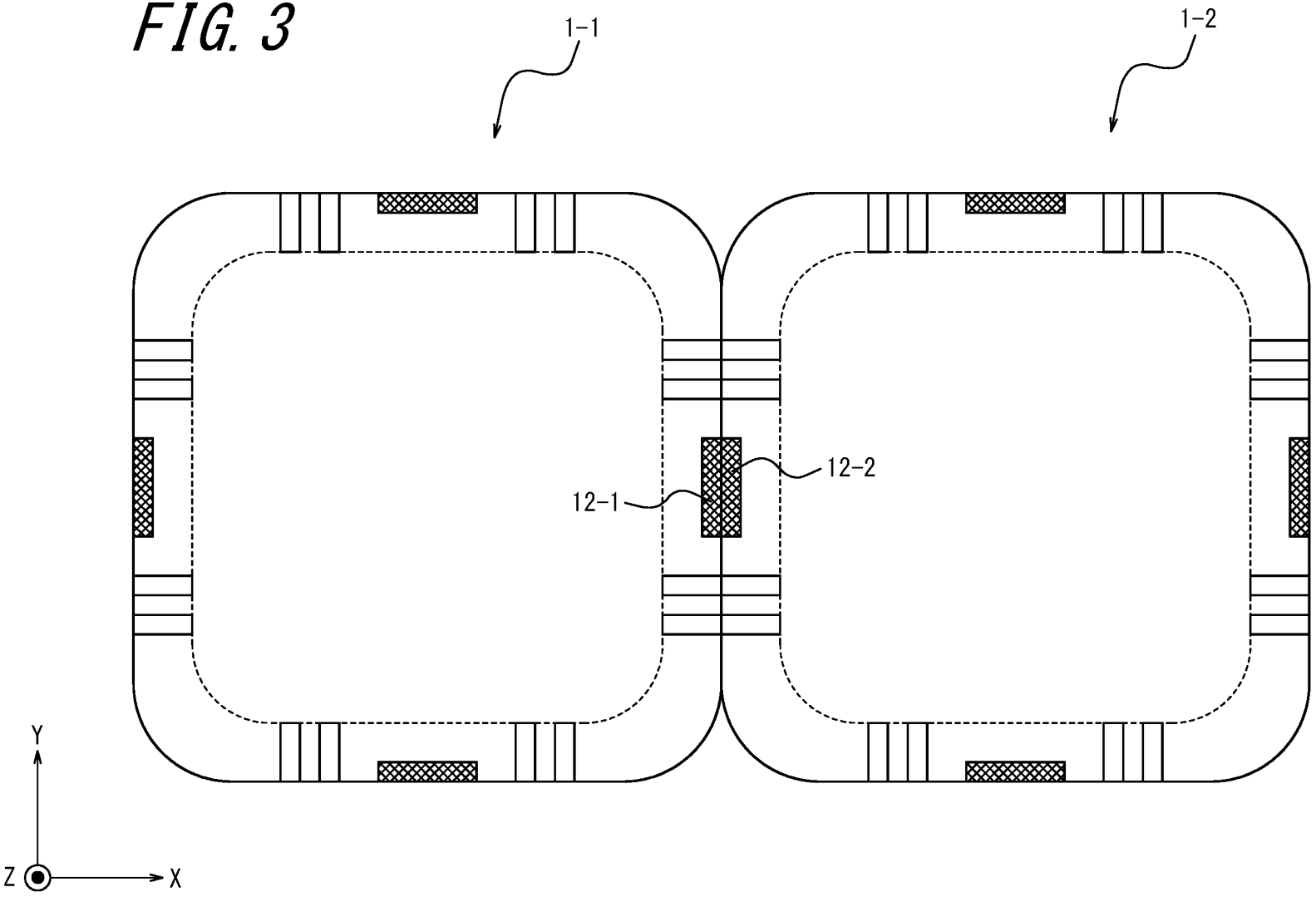
FIG. 3 illustrates how the connection units illustrated in FIG. 1 are connected two-dimensionally.

The magnet 12 is magnetically connectable to a magnet 12 of another connection unit 1, allowing the connection units 1 to be magnetically connected to each other. FIG. 3 illustrates how a magnet 12-1 of a connection unit 1-1 and a magnet 12-2 of a connection unit 1-2 are magnetically connected. As illustrated in FIG. 3, the connection unit 1-1 and the connection unit 1-2 can be magnetically connected to each other by the magnet 12-1 and the magnet 12-2 being magnetically connected to each other.

Figure 4:
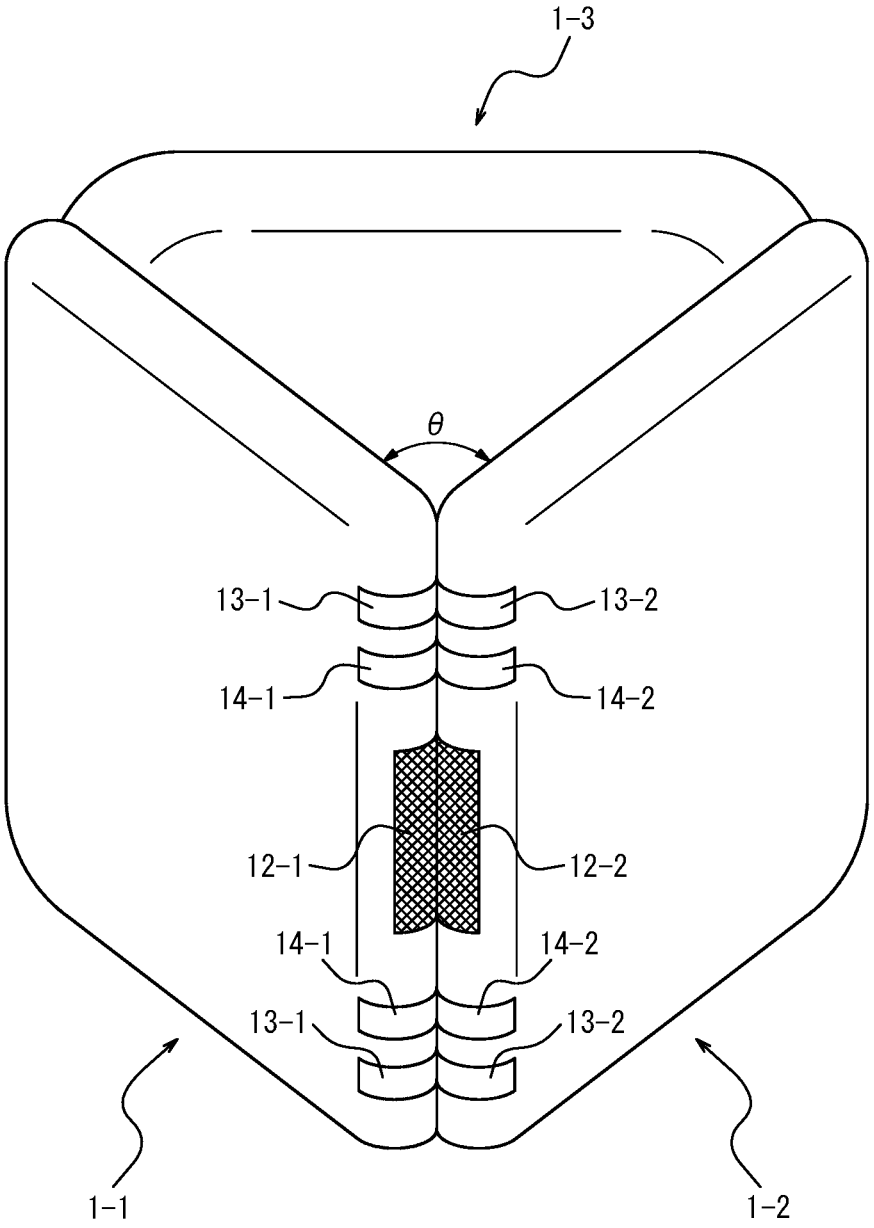
FIG. 4 illustrates an example of how the connection units illustrated in FIG. 1 are connected three-dimensionally.

FIG. 4 illustrates how a connection unit 1-1, a connection unit 1-2, and a connection unit 1-3 are connected to one another into a three-dimensional assembly. As illustrated in FIG. 4, a magnet 12-1 of the connection unit 1-1 and a magnet 12-2 of the connection unit 1-2 allow the connection unit 1-1 and the connection unit 1-2 to be magnetically connected to each other even when the connection angle θ between the connection unit 1-1 and the connection unit 1-2 is a sharp angle.

FIG. 4 illustrates an embodiment wherein the connection angle θ between the connection unit 1-1 and the connection unit 1-2 is a sharp angle. However, the magnet 12-1 and the magnet 12-2 allow the connection unit 1-1 and the connection unit 1-2 to be magnetically connected to each other even when the connection angle θ is a right angle or obtuse angle.

The magnet 12 may be fixedly or rotatably disposed on the peripheral edge of the body 11. When rotatably disposed, the magnet 12 is, for example, cylindrical in shape and may be disposed on the peripheral edge of the body 11 such that the axis of the cylinder is parallel to the sides of the peripheral edge of the body 11. The cylindrical magnet 12 is rotatable about the axis of the cylinder when a cylindrical or cuboidal cavity that is slightly larger than the cylindrical magnet 12 is formed in the peripheral edge of the body 11 and then the cylindrical magnet 12 is housed in that cavity.

As illustrated in FIG. 1, the positive electrode terminal 13 and the negative electrode terminal 14 are disposed side-by-side with the magnet 12 on each side of the peripheral edge of the body 12 where the magnet 12 is disposed. In the example illustrated in FIG. 1, the magnet 12 is disposed on each of the four sides of the body 11, so that the positive electrode terminal 13 and the negative electrode terminal 14 are also disposed on each of the four sides of the body 11.

At least one positive electrode terminal 13 is disposed on one side of the peripheral edge of the body 11 where the magnet 12 is disposed. In the example illustrated in FIG. 1, two positive electrode terminal 13 are disposed on each side of the peripheral edge of the body 11 where the magnet 12 is disposed.

At least one negative electrode terminal 14 is disposed on one side of the peripheral edge of the body 11 where the magnet 12 is disposed. In the example illustrated in FIG. 1, two negative electrode terminals 14 are disposed on each side of the peripheral edge of the body 11 where the magnet 12 is disposed.

Referring to the schematic configuration of the cross section illustrated in FIG. 2A taken along line A-A in FIG. 1, the positive electrode terminal 13 is disposed along the curved surface of the outer surface 31 of the body 11. Although not illustrated, the negative electrode terminal 14 is also disposed along the curved surface of the outer surface 31 of the body 11 similarly to the positive electrode terminal 13.

The positive electrode terminal 13 and the negative electrode terminal 14 may for example be ribbon-shaped conductors which are disposed along the curved surface of the outer surface 31 of the body 11.

The surface of the positive electrode terminal 13 is composed of conductor. When the connection unit 1 is magnetically connected to another connection unit 1 by means of magnetic coupling by the magnets 12, the surface of the positive electrode terminal 13 of the connection unit 1 contacts the surface of the positive electrode terminal 13 of the other connection unit 1. At this time, the positive electrode terminal 13 of the connection unit 1 is electrically connected to the positive electrode terminal 13 of the other connection unit 1.

The surface of the negative electrode terminal 14 is composed of conductor. When the connection unit 1 is magnetically connected to another connection unit 1 by means of magnetic coupling by the magnets 12, the surface of the negative electrode terminal 14 of the connection unit 1 contacts the surface of the negative electrode terminal 14 of the other connection unit 1. At this time, the negative electrode terminal 14 of the connection unit 1 is electrically connected to the negative electrode terminal 14 of the other connection unit 1.

As illustrated in FIG. 2A, the positive electrode terminal 13 is disposed along the curved surface of the outer surface 31 of the body 11. Thus, as illustrated in FIG. 4, even when the connection angle θ between the connection unit 1-1 and the connection unit 1-2 is a sharp angle, the positive electrode terminal 13-1 of the connection unit 1-1 and the positive electrode terminal 13-2 of the connection unit 1-2 can be electrically connected to each other.

While FIG. 4 illustrates an embodiment wherein the connection angle θ between the connection unit 1-1 and the connection unit 1-2 is a sharp angle, the positive electrode terminal 13-1 and the positive electrode terminal 13-2 can be electrically connected to each other even when the connection angle θ is a right angle or obtuse angle. That is, the connection angle θ can have a high degree of freedom as to establishment of an electrical connection between the positive electrode terminal 13-1 and the positive electrode terminal 13-2.

The negative electrode terminal 14 is also disposed along the curved surface of the outer surface 31 of the body 11 similarly to the positive electrode terminal 13. Thus, the connection angle θ can also have a high degree of freedom as to establishment of an electrical connection between the negative electrode terminal 14-1 and the negative electrode terminal 14-2 illustrated in FIG. 4.

Figure 2B:
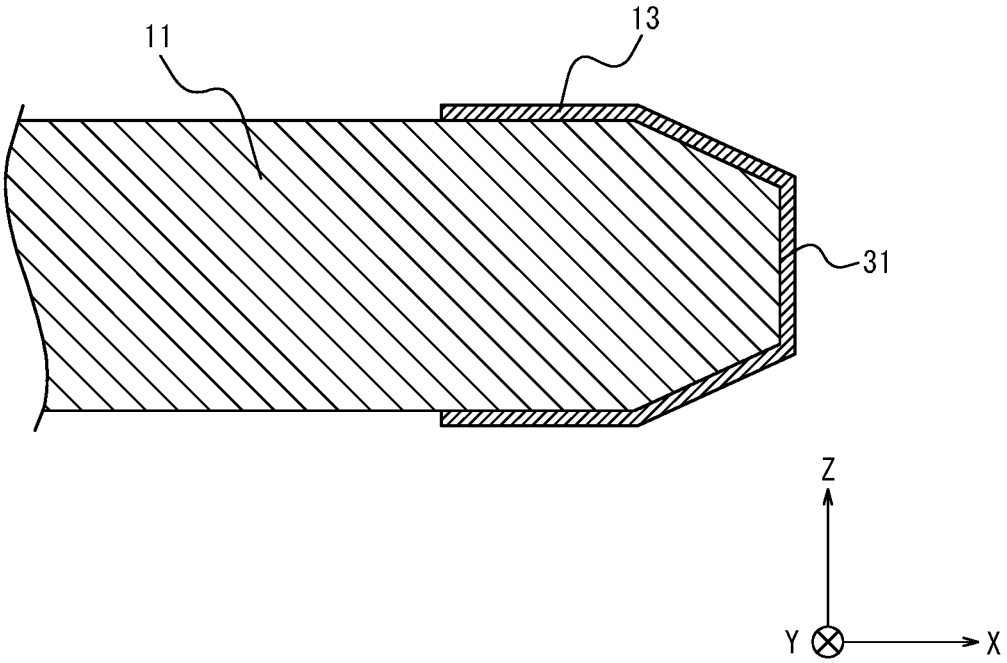
FIG. 2B illustrates another example of a schematic configuration of a cross section of the connection unit illustrated in FIG. 1 taken along line A-A.

As illustrated in FIG. 2B, the outer surface 31 of the body 11 may have a surface having a polygonal cross section. In this case, the positive electrode terminal 13 is disposed along the surface of the outer surface 31 which has a polygonal cross section. In this case, although not illustrated, the negative electrode terminal 14 is also disposed along the surface of the outer surface 31 which has a polygonal cross section as with the positive electrode terminal 13. The connection angle θ can have a high degree of freedom as to establishment of an electrical connection between the positive electrode terminal 13-1 and the positive electrode terminal 13-2 illustrated in FIG. 4 even when the outer surface 31 of the body 11 has a shape such as that illustrated in FIG. 2B. Further, the connection angle θ can have a high degree of freedom as to establishment of an electrical connection between the negative electrode terminal 14-1 and the negative electrode terminal 14-2 illustrated in FIG. 4.

As illustrated in FIG. 1, the positive electrode terminals 13 are disposed so as to be line-symmetrical about the perpendicular line L perpendicular to the center of each side of the peripheral edge of the body 11. As illustrated in FIG. 1, the negative electrode terminals 14 are also disposed so as to be line-symmetrical about the perpendicular line L perpendicular to the center of each side of the peripheral edge of the body 11.

With the positive electrode terminals 13 being disposed so as to be line-symmetrical about the perpendicular line L as described above, even when the connection unit 1 is turned over, the positive electrode terminal 13 of the connection unit 1 and the positive electrode terminal 13 of another connection unit 1 can be electrically connected to each other at the time when the two connection units 1 are magnetically connected to each other. Similarly, with the negative electrode terminals 14 being disposed so as to be line-symmetrical about the perpendicular line L as described above, even when the connection unit 1 is turned over, the negative electrode terminal 14 of the connection unit 1 and the negative electrode terminal 14 of another connection unit 1 can be electrically connected to each other at the time when the two connection units 1 are magnetically connected to each other.

Thus, with the positive electrode terminals 13 and the negative electrode terminals 14 being disposed so as to be line-symmetrical about the perpendicular L, the user can magnetically connect one connection unit 1 to another regardless the orientation of the surface of the connection units 1. Further, with the positive electrode terminals 13 and the negative electrode terminals 14 being disposed so as to be line-symmetrical about the perpendicular line L, the user can connect the positive electrode terminals 13 to each other and the negative electrode terminals 14 to each other without having to choose a specific side of the peripheral edge of a connection unit 1 for a specific side of the peripheral edge of another connection unit 1 when magnetically connecting the connection units 1 to each other.

A total of at least three positive electrode terminal(s) 13 and negative electrode terminal(s) 14 are disposed on one side of the peripheral edge of the body 11. This makes it possible to dispose the positive electrode terminal(s) 13 and the negative electrode terminal(s) 14 so as to be line-symmetrical about the perpendicular line L.

The circuit element 15 is disposed inside the body 11. The phrase "disposed inside" as used herein means that, when the body 11 has a flat plate shape, the circuit element 15 is disposed in the inside of the body 11 and means that when the body 11 has a frame shape having an opening, at least a portion of the circuit element 15 is disposed in the opening of the body 11.

The circuit element 15 may have a flat plate shape, for example. In the example illustrated in FIG. 1, a circuit element 15 having a flat plate shape is disposed in the inside of the body 11 having a flat plate shape.

The circuit element 15 is electrically connected to the positive electrode terminal 13 and the negative electrode terminal 14. The circuit element 15 can be electrically connected to the circuit element 15 of another connection unit when the connection unit 1 is magnetically connected to the other connection unit 1.

The circuit element 15 may include an energy harvesting element capable of outputting power, generated by energy harvesting, from the positive electrode terminal 13 and the negative electrode terminal 14. Alternatively, the circuit element 15 may include a load element capable of consuming power that is input from the positive electrode terminal 13 and the negative electrode terminal 14.

The energy harvesting element is capable of generating power by energy harvesting. That is, the energy harvesting element generates power according to the external environment. Therefore, the power generated by the energy harvesting element varies depending on the external environment. The energy harvesting element has, for example, a solar cell which generates power by utilizing light energy such as sunlight or indoor light. Alternatively, the energy harvesting element has, for example, a thermoelectric conversion element that generates power by utilizing thermal energy such as geothermal heat.

The energy harvesting element of the present embodiment includes a solar cell panel composed of solar cells. The solar cell panel is a member including solar cells configured to output power by photoelectrically converting incident light such as sunlight or indoor light. The types of solar cells to be included in a solar cell panel are broadly classified into inorganic solar cells using an inorganic material, and organic solar cells using an organic material. Examples of inorganic solar cells include silicon (Si) solar cells in which silicon is used and compound solar cells in which a compound is used. Examples of organic solar cells include a low-molecular vapor deposition system using an organic pigment, a polymer coating system using a conductive polymer, a thin film system such as a coating conversion system using a conversion-type semiconductor, and a dye-sensitized system comprising titania, an organic dye, and an electrolyte. Solar cells to be included in a solar cell panel may also include organic-inorganic hybrid solar cells and solar cell using a perovskite compound. The solar cell panel may be in the form of a thin panel. In this case dye-sensitized solar cells formed on a plastic or other film are preferred because it is easy to form a thin solar cell panel. When the solar cell panel is such a thin solar panel, the solar cell panel is not limited to one in which solar cells are formed on a plastic or other film; any mode can be employed as long as the solar cell panel is thin. When the solar cell panel is a thin solar panel, it preferably has a thickness of, for example, 10 μm or more and 3 mm or less from the viewpoint of manufacturing techniques.

The load element is any load capable of consuming power. The load element may be, for example, a light-emitting element such as a light-emitting diode (LED), a speaker, or a secondary battery.

For example, when the connection unit 1-1 illustrated in FIG. 3 includes a solar cell panel as the circuit element 15 and the connection unit 1-2 includes an LED as the circuit element 15, it is possible to cause the LED of the connection unit 1-2 to emit light by using the power generated by the solar cell panel of the connection unit 1-1.

Thus, a plurality of connection units 1, when magnetically connected into an assembly, can utilize the power generated by a connection unit 1 to drive the load element of another connection unit 1. This allows the user to enjoy the plurality of connection units 1 as an assembled toy with electrical elements. Also, the user can connect the plurality of connection units 1 into an assembly and enjoy it as an interior accessory such as a lighting device.

The portion of the inside of the body 11, where the circuit element 15 is disposed, is preferably transparent. The circuit element 15 itself is also preferably transparent. The term "transparent" as used herein means not only completely transparent, but also transparent to an extent that light transmittance is relatively high.

When the plurality of connection units 11 including a connection unit 1 having an LED as the circuit element 15 are assembled, for example, the transparency of the body 11 and the circuit element 15 allows the light from the LED to be transmitted to the outside of the three-dimensional assembly. Further, when the plurality of connection units 1 includes a connection unit 1 having a solar cell panel as the circuit element 15 and the connection units 1 are assembled such that the light-receiving surface of the solar cell panel faces toward the inside of the three-dimensional assembly, it is possible to cause the solar cell panel to generate power by the incident light that has passed through the connection unit 1 from the outside.

Figure 5:
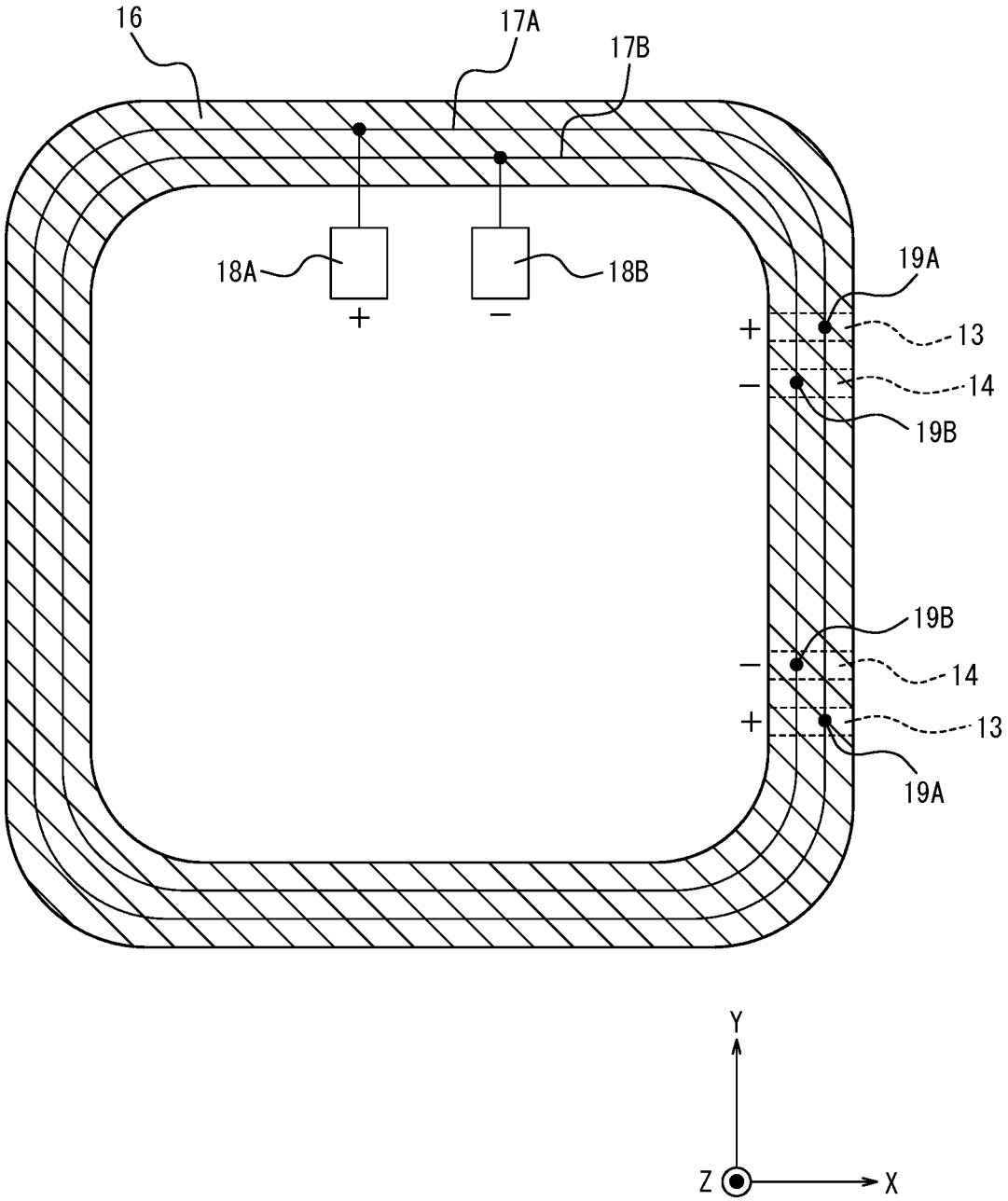
FIG. 5 illustrates a schematic configuration of a wiring board disposed in the inside of the connection unit illustrated in FIG. 1.

The body 11 may include a wiring board in the inside of the body 11. FIG. 5 illustrates an example of a wiring board 16 disposed in the inside of the body 11.

The wiring board 16 may have a frame shape in plan view. The wiring board 16 includes a wiring 17A and a wiring 17B. The wiring board 16 may be a flexible or rigid board, but is preferably a flexible board from the viewpoint of weight reduction.

The wiring 17A is electrically connected to a positive electrode 18A of the circuit element 15. Further, the wiring 17A is connected to the positive electrode terminal 13 at a connection point 19A.

The wiring 17B is electrically connected to a negative electrode 18B of the circuit element 15. Further, the wiring 17B is connected to the negative electrode terminal 14 at a connection point 19B.

In FIG. 5, only the positive electrode terminal 13 and negative electrode terminal 14 on one side on the positive side of X-axis are illustrated, and the positive electrode terminals 13 and negative electrode terminals 14 on the other sides are not illustrated.

With the wiring board 16 provided in the inside of the body 11 as described above, it is possible to simply establish a connection between the circuit element 15 and the positive electrode terminal 13 and negative electrode terminal 14 in a space-saving manner.

(First Modification)

Figure 6:
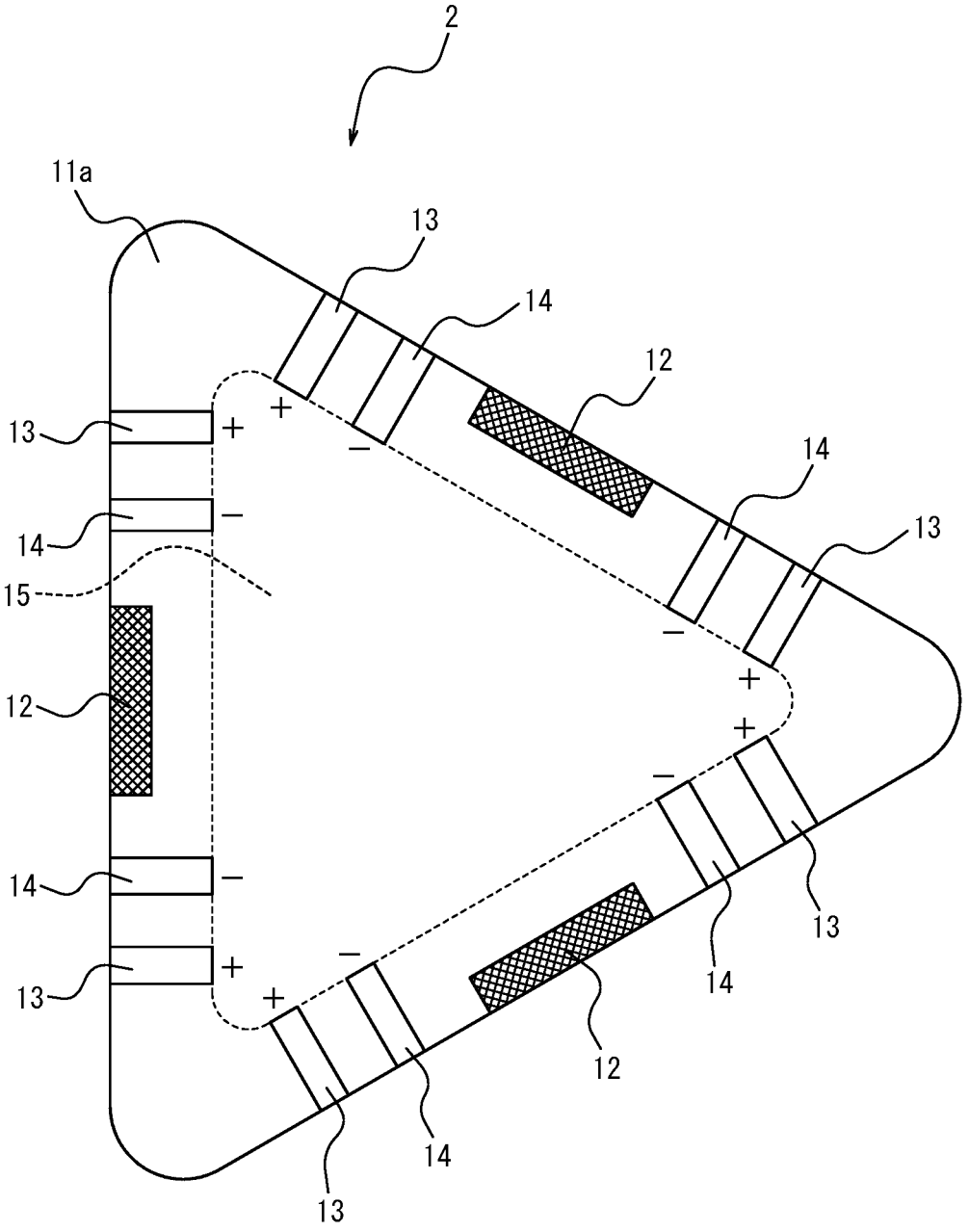
FIG. 6 illustrates a schematic configuration of a connection unit according to a first modification.

FIG. 6 illustrates a schematic configuration of a connection unit 2 according to a first modification. As illustrated in FIG. 6, a body 11*a* of the connection unit 2 has a triangle shape with curved corners in plan view.

The body 11 of the connection unit 1 illustrated in FIG. 1 has been described above as having a substantially polygonal shape in plan view. FIG. 6 illustrates a specific example wherein the body 11 has a substantially triangular shape.

Thus, the body 11 according to the present embodiment may be of various shapes. This makes it possible to increase the degree of freedom in forming a three-dimensional assembly by combining a plurality of connection units 1.

(Second Modification)

Figure 7:
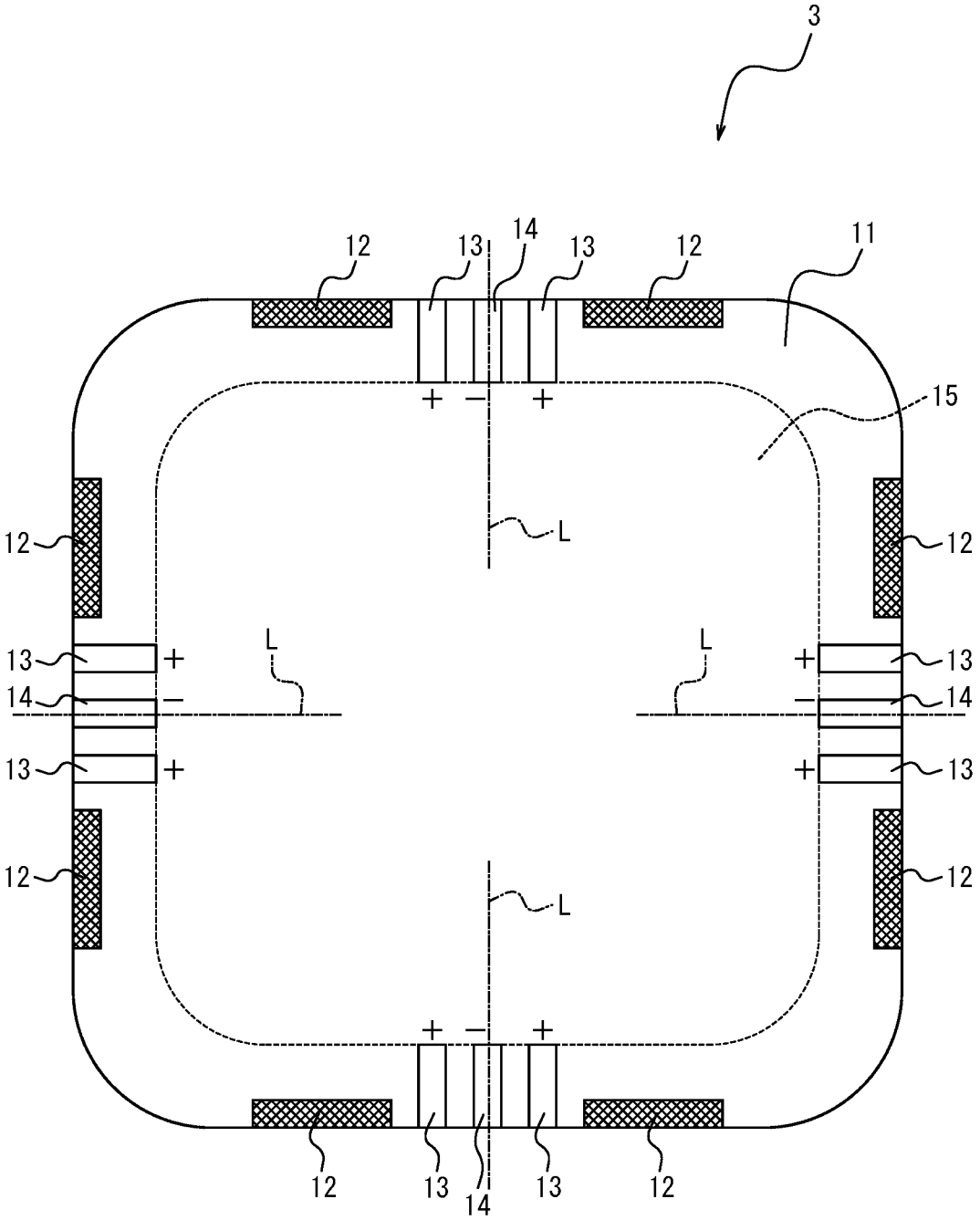
FIG. 7 illustrates a schematic configuration of a connection unit according to a second modification.

FIG. 7 illustrates a schematic configuration of a connection unit 3 according to a second modification.

The connection unit 3 has two magnets 12 on each side of the peripheral edge of the body 11. Thus, the number of the magnets 12 disposed on each side of the peripheral edge of the body 11 is not limited to one, which is illustrated in FIG. 1; any number of the magnets 12 may be disposed.

The connection unit 3 has two positive electrode terminals 13 and one negative electrode terminal 14 on each side of the peripheral edge of the body 11. Thus, the numbers of the positive electrode terminal 13 and the negative electrode terminal 14 disposed on each side of the peripheral edge of the body 11 are not limited to those in the example illustrated in FIG. 1; any numbers of the positive electrode terminals 13 and the negative electrode terminals 14 may be disposed so long as the total number of the positive electrode terminal(s) 13 and the negative electrode terminal(s) 14 is at least 3.

(Third Modification)

Figure 8:
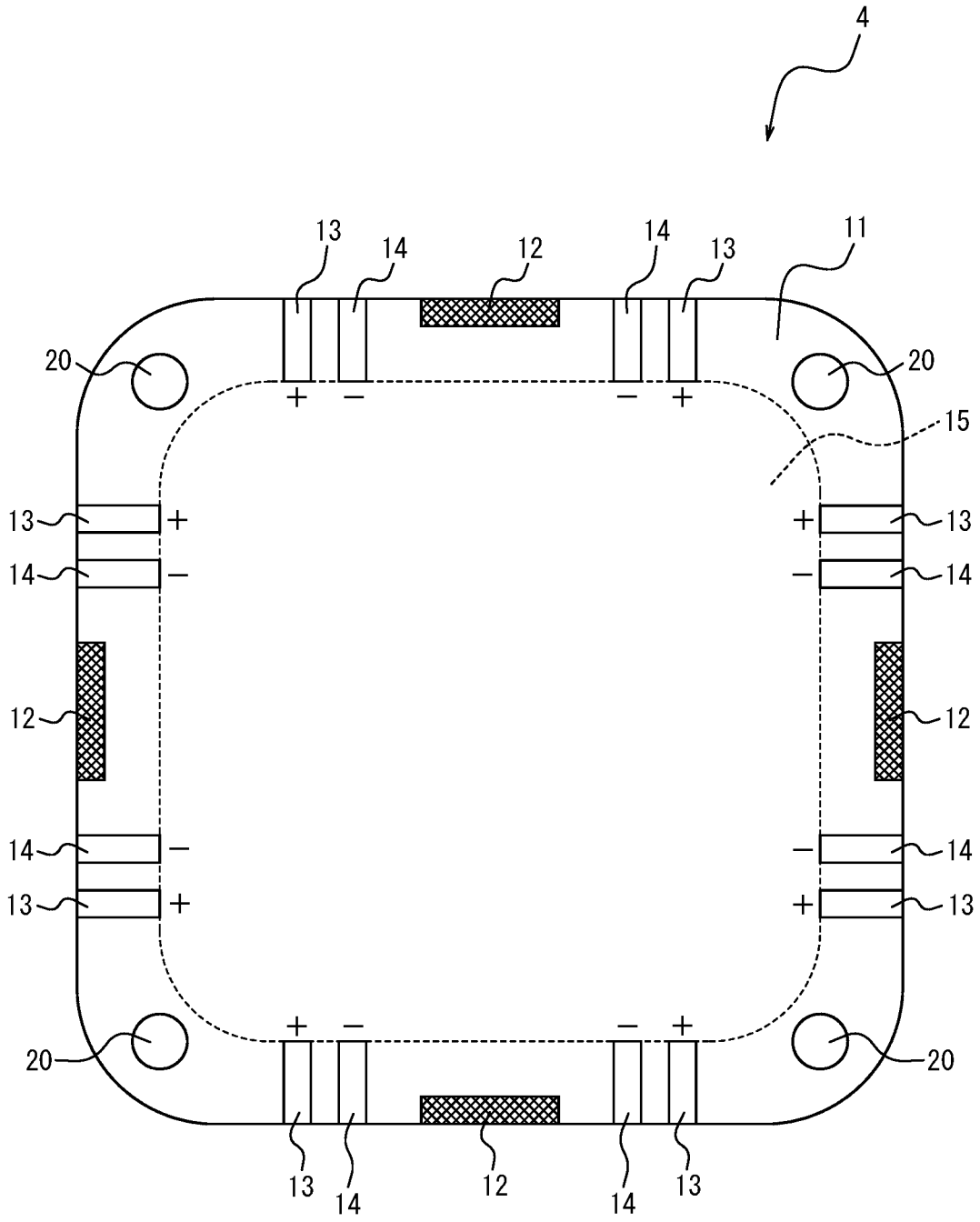
FIG. 8 illustrates a schematic configuration of a connection unit according to a third modification.

FIG. 8 illustrates a schematic configuration of a connection unit 4 according to a third modification. The connection unit 4 has light-emitting elements 20, each of which functions as a load element, on the peripheral edge of the body 11. The light emitting element 20 is electrically connected to the positive electrode terminal 13 and the negative electrode terminal 14.

With the light-emitting elements 20 provided on the peripheral edge of the body 11 as described above, when the wiring board 16 configured to connect the light-emitting element 20 which functions as a load element to the positive electrode terminal 13 and the negative electrode terminal 14 is disposed on the peripheral edge of the body 11, it is possible to mount the light-emitting element 20 simultaneously on the wiring board 16. Thus, the connection unit 4 can have a lighting function easily with a small configuration.

(Fourth Modification)

Figure 9:
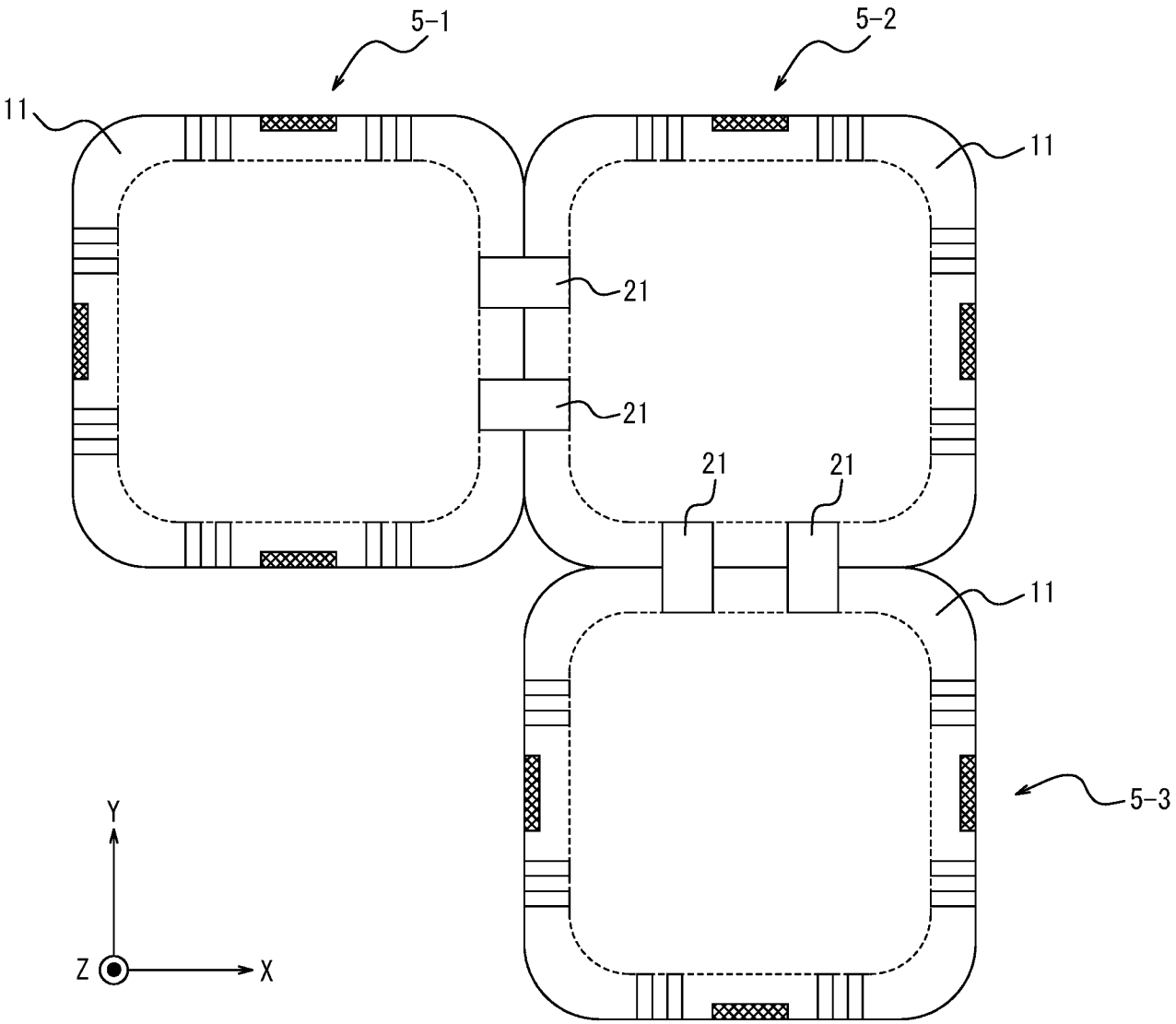
FIG. 9 illustrates a schematic configuration of a connection unit according to a fourth modification.

FIG. 9 illustrates how connection units 5 according to a fourth modification are connected to one another.

In the connection unit 5, at least one side of the peripheral edge of the body 11 does not have the magnet 12, the positive electrode terminal 13 and the negative electrode terminal 14 which are illustrated in FIG. 1.

In the example illustrated in FIG. 9, the connection unit 5-1 does not have the magnet 12, the positive electrode terminal 13 and the negative electrode terminal 14 on one side present on the positive side of the X-axis. The connection unit 5-2 does not have the magnet 12, the positive electrode terminal 13 and the negative electrode terminal 14 on two sides present on the negative sides of the X-axis and Y-axis, respectively. The connection unit 5-3 does not have the magnet 12, the positive electrode terminal 13 and the negative electrode terminal 14 on one side present on the positive side of the Y-axis.

The one side of the connection unit 5-1 on the positive side of the X-axis and the one side of the connection unit 5-2 on the negative side of the X-axis are connected to each other by connection elements 21. The connection element 21 mechanically and electrically connect the connection unit 5-1 and the connection unit 5-2. The connection element 21 mechanically connects the connection unit 5-1 and the connection unit 5-2 such that the connection angle θ has a degree of freedom that allows the connection unit 5-1 and the connection unit 5-2 to be connected to each other at various connection angles θ.

The one side of the connection unit 5-2 on the negative side of the Y-axis and the one side of the connection unit 5-3 on the positive side of the Y-axis are connected to each other by connection elements 21. The connection element 21 mechanically and electrically connect the connection unit 5-2 and the connection unit 5-3. The connection element 21 mechanically connects the connection unit 5-2 and the connection unit 5-3 such that the connection angle θ has a degree of freedom that allows the connection unit 5-2 and the connection unit 5-3 to be connected to each other at various connection angles θ.

By connecting a plurality of connection units 5 by the connection elements 21 in advance as described above, it is possible to reduce the number of process steps when forming a three-dimensional assembly using, for example, the connection units 5 and connection unit 1 illustrated in FIG. 1.

(Fifth Modification)

Figure 10A:
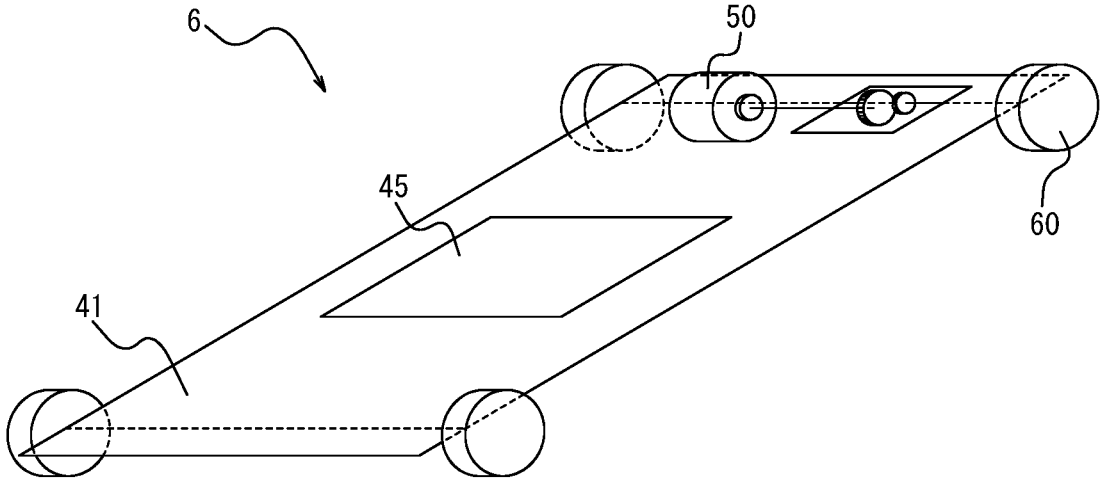
FIG. 10A illustrates an example of a schematic configuration of a connection unit according to a fifth modification.

FIG. 10A illustrates an example of a schematic configuration of a connection unit 6 according to a fifth modification. As illustrated in FIG. 10A, the connection unit 6 is a toy representing a vehicle. The connection unit 6 includes a body 41, a motor 50, and tires 60.

The body 41 has a flat plate shape. The body 41 is substantially quadrangular in shape in plan view. The body 11 may be made of resin or other material.

The body 41 has a connection surface 45 as illustrated in FIG. 10A. The connection surface 45 is a surface onto which the connection unit 1 etc. illustrated in FIG. 1 is to be mounted such that the connection unit 1 is connectable with the connection unit 6 illustrated in FIG. 10A.

Figure 11:
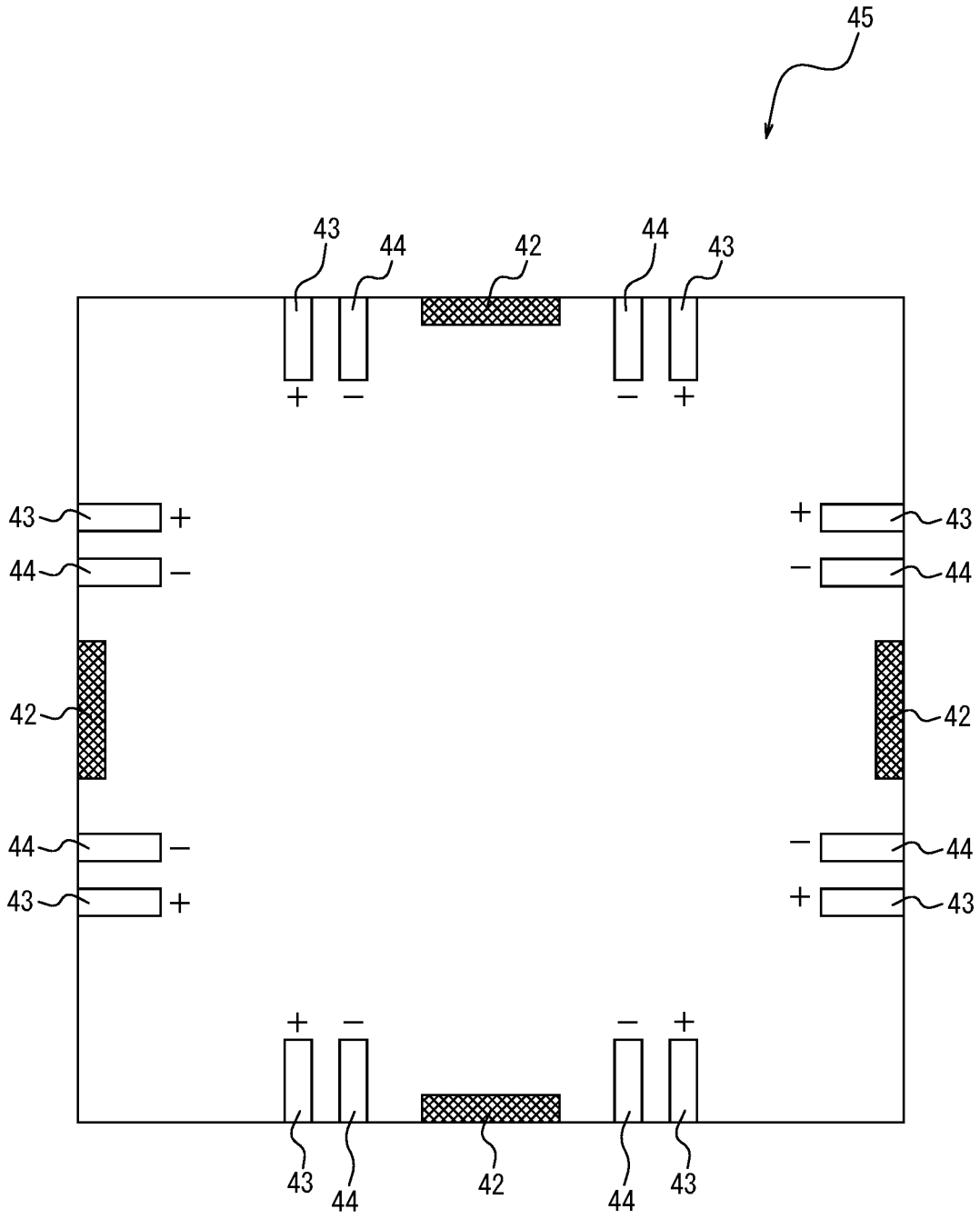
FIG. 11 illustrates an example of a schematic configuration of a connection surface illustrated in FIG. 10A or FIG. 10B.

FIG. 11 illustrates an example of a schematic configuration of the connection surface 45. The connection surface 45 includes magnets 42, positive electrode terminals 43, and negative electrode terminals 44.

The magnets 42 are disposed on the connection surface 45 at positions corresponding to the magnets 12 illustrated in FIG. 1 such that when the connection unit 1 etc. illustrated in FIG. 1 is disposed on the connection surface 45, the magnets 42 and the magnets 12 illustrated in FIG. 1 are magnetically connectable.

The positive electrode terminals 43 are disposed on the connection surface 45 at positions corresponding to the positive electrode terminals 13 illustrated in FIG. 1 such that when the connection unit 1 etc. illustrated in FIG. 1 is disposed on the connection surface 45, the positive electrode terminals 43 and the positive electrode terminals 13 illustrated in FIG. 1 are electrically connectable.

The negative electrode terminals 44 are disposed on the connection surface 45 at positions corresponding to the negative electrode terminals 14 illustrated in FIG. 1 such that when the connection unit 1 etc. illustrated in FIG. 1 is disposed on the connection surface 45, the negative electrode terminals 44 and the negative electrode terminals 14 illustrated in FIG. 1 are electrically connectable.

The motor 50 is disposed in the body 41 as illustrated in FIG. 10A. The motor 50 is electrically connected to the positive electrode terminals 43 and the negative electrode terminals 44 illustrated in FIG. 11 via wirings.

When the connection unit 1 illustrated in FIG. 1 comprises a solar cell panel as the circuit element 15, for example, disposing the connection unit 1 on the connection surface 45 drives the motor 50 by the power generated by the connection unit 1.

The tires 60 are mechanically connected to the motor 50 via axles so as to be driven by the motor 50 to rotate. When the motor 50 is driven by the power generated by the connection unit 1, the tires 60 rotate accordingly. As the tires 60 rotate, the entire connection unit 6 can travel.

The connection unit 6 may further include a switch for switching the connection between the motor 50 and the positive electrode terminal 43 and negative electrode terminal 44. By providing such a switch, the connection unit 6 can prevent the motor 50 from being driven while the power generated by the connection unit 1 is supplied.

It is possible for the connection unit 6 to place on the connection surface 45 a three-dimensional assembly formed of a plurality of connection units 1 such as those illustrated in FIG. 1. When the assembly includes a connection unit 1 with a solar cell panel as the circuit element 15, the connection unit 6 can run with the assembly mounted thereon.

Figure 10B:
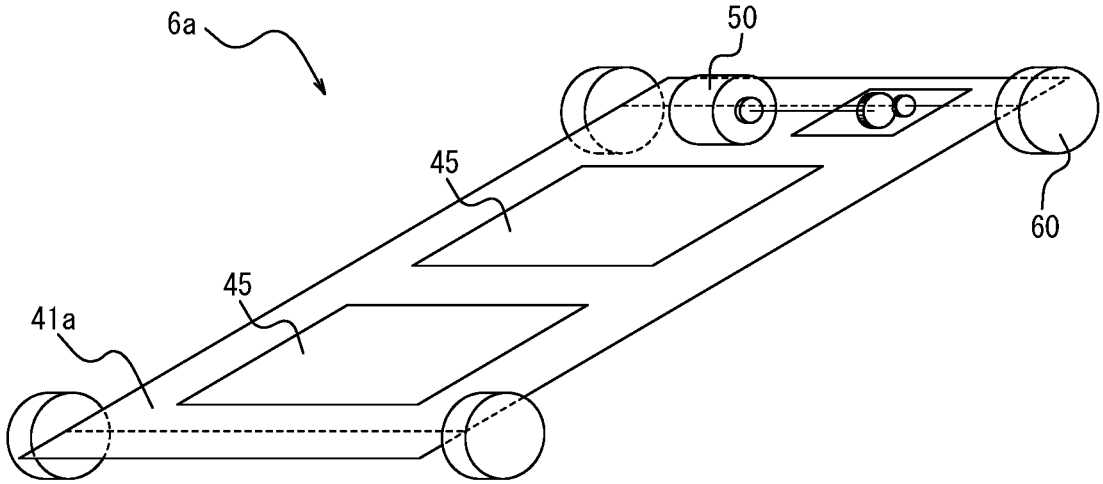
FIG. 10B illustrates another example of a schematic configuration of the connection unit according to the fifth modification.

FIG. 10B is an illustration of a connection unit 6*a* according to another example of the fifth modification. Unlike the connection unit 6 illustrated in FIG. 10A, a body 41*a* of the connection unit 6*a* has two connection surfaces 45. By having two connection surfaces 45 as described above, the connection unit 6*a* can increase the degree of freedom of the assembly of the connection units 1 to be placed on the connection surfaces 45.

The foregoing description merely illustrates one embodiment of the present disclosure and it goes without saying that various modifications may be made in the claims.

For example, while the body 11 has been described above as having a substantially polygonal shape in plan view, the body 11 may be of shapes which are not substantially polygonal so long it has one side on the peripheral edge, e.g., the remaining portion of the peripheral edge has an arc shape.

INDUSTRIAL APPLICABILITY

According to the present disclosure, it is possible to provide a connection unit which is magnetically and electrically connectable.

REFERENCE SIGNS LIST

1, 2, 3, 4, 5, 6, 6*a* Connection unit
11, 11*a* Body
12 Magnet
13 Positive electrode terminal (electrode terminal)
14 Negative electrode terminal (electrode terminal)
15 Circuit element
16 Wiring board
17A, 17B Wiring
18A Positive electrode
18B Negative electrode
19A, 19B Connection point
20 Light-emitting element
21 Connection element
31 Outer surface
41, 41*a* Body
42 Magnet
43 Positive electrode terminal
44 Negative electrode terminal
45 Connection surface
50 Motor
60 Tire

The invention claimed is:

1. A connection unit comprising:

a body having a substantially flat plate shape and peripheral edges;

a plurality of magnets, two of which being disposed on each side of the peripheral edges of the body; and a plurality of electrode terminals, at least three of which being disposed on the each side of the peripheral edges of the body, wherein the plurality of electrode terminals and the plurality of magnets are disposed at different positions, an outer surface of the each side of the body has a curved surface which curves in a thickness direction or a surface having a polygonal cross section, the electrode terminals are disposed along the curved surface or the surface having the polygonal cross section of the outer surface, the at least three electrode terminals disposed on the each side of the peripheral edges of the body comprise either:

one positive electrode terminal and two negative electrode terminals, the positive electrode terminal being disposed at a center of the respective side of the peripheral edges of the body and the negative electrode terminals being disposed line-symmetrical about a perpendicular line perpendicular to and crossing the center of the respective side of the body, or one negative electrode terminal and two positive electrode terminals, the negative electrode terminal being disposed at the center of the respective side of the peripheral edges of the body and the positive electrode terminals being disposed line-symmetrical about the perpendicular line perpendicular to and crossing the center of the respective side of the body, and the two magnets disposed on the each side of the peripheral edges of the body are disposed line-symmetrical about the perpendicular line perpendicular to and crossing the center of the respective side of the body.

2. The connection unit according to claim 1, further comprising a circuit element disposed inside the body, wherein the circuit element is electrically connected to the electrode terminals.

3. The connection unit according to claim 2, further comprising a wiring board disposed in the inside of the body, wherein the circuit element is electrically connected to the electrode terminals via a wiring of the wiring board.

4. The connection unit according to claim 2, wherein the circuit element comprises an energy harvesting element capable of outputting power, generated by energy harvesting, to the electrode terminals.

5. The connection unit according to claim 2, wherein the circuit element comprises a load element capable of consuming power that is input from the electrode terminals.

6. The connection unit according to claim 5, wherein the load element is a light-emitting element.

7. The connection unit according to claim 1, further comprising at one of the peripheral edges of the body, a load element that is electrically connected to one of the one or more positive electrode terminals and one of the one or more negative electrode terminals.

8. The connection unit according to claim 1, wherein the body has a substantially polygonal shape in plan view.

9. The connection unit according to claim 1, wherein the body has a frame shape having an opening.

* * * * *